United States Patent [19]

Dobine

[11] Patent Number: 5,014,373

[45] Date of Patent: May 14, 1991

[54] BATH PILLOW

[76] Inventor: Dwayne Dobine, 8145 Terry, Detroit, Mich. 48228

[21] Appl. No.: 239,916

[22] Filed: Sep. 2, 1988

[51] Int. Cl.[5] ..... A47G 9/00

[52] U.S. Cl. ..... 4/575; 5/437

[58] Field of Search ..... 5/437, 434, 436, 441; 4/575, 571, 573, 559; D6/601, 604

[56] References Cited

U.S. PATENT DOCUMENTS

| | | | |
|---|---|---|---|
| 1,721,571 | 7/1929 | Miller | 5/441 |
| 2,167,178 | 7/1939 | Kohlstadt | 4/575 |
| 2,483,077 | 9/1949 | Walsm | 4/575 |
| 2,582,439 | 1/1952 | Kavanagh | 5/455 |
| 3,078,474 | 2/1963 | Chaitlen | 4/575 |
| 3.140,557 | 7/1964 | Albrycht | 4/559 |
| 4,506,396 | 3/1985 | Ritchie, Jr. et al. | 5/437 |
| 4,794,657 | 1/1989 | Avery | 5/437 |

OTHER PUBLICATIONS

1988 Catalog of Lillian Vernon Corporation, p. 33 vol. 805 510 South Fulton Ave, Mount Vernon, N.Y. 10550.

*Primary Examiner*—Alexander Grosz

*Attorney, Agent, or Firm*—Dykema Gossett

[57] ABSTRACT

A bath pillow is adapted to be supported by and anchored to a bathtub-like structure and a wall structure. A user may rest his or her head and back against the bath pillow. A first support cushion supports the head and a second support cushion supports the shoulder region of the back. The support cushions are detachably attached to one another and ajustable iwth respect to one another so as to conform to a desired orthopedic support relationship between the head and shoulder region of the back. Suction cups are anchored to the wall and tub, and straps bridge between the cushions and the suction cups.

18 Claims, 1 Drawing Sheet

BATH PILLOW

BACKGROUND OF THE INVENTION

The present invention relates to pillows supporting the head and back of a person while the person soaks in a bathtub, and moe particularly, to a bath pillow that may be anchored to a surface of a bathtub and to a surface of the ceramic wares that surround the bathtub, so that a person lying in the bathtub may lean against the pillow for support of his or her head and back.

It is a common practice for bathers to soak in the bathtub while resting head and shoulders against the ceramic wall that usually surrounds the tub or against the ceramic surface of the tub itself. Such resting place for the head and shoulders is very uncomfortable and lacks the bouyant support that the rest of the body receives from the water in the bathtub. By soaking in the tub, the bather takes full advantage of the therapeutic and cleansing properties of water. These properties may be enhanced by prolonged soaking in water that is mechanically agitated or chemically enhanced with bubble bath or salt solutions. One would not wish to undermine the advantages of soaking by shortening the duration of discomfort in resting head and shoulders.

Use of a bath pillow for soaking is not novel. One example of a bath pillow marketed to the filing of an application on the present invention can be found on page 33 of a 1988 catalog copyrighted by the Lillian Vernon Corporation, 510 South Fulton Avenue, Mt. Vernon, N.Y. 10550. The device shown in the catalog is a luxury bath pillow that cushions the head an neck. The device has a shell shape that cradles the user and keeps the user'hair dry. Two strong suction cups grip the tub against slipping and sliding.

The device shown in the catalog is inflated to cushion its user againts the hard surfaces of the tub and surrounding wall. Because it is inflated, the device must be used with care to guard against puncture, chemical penetration, and wear. The device also is structured so that the body weight must be pushed against the suction cups to hold its securement to the tub surface. This structural relationship requires that its user be cradled within the shell in a set manner and does not allow its user to seek his or here own comfort zone. Finally, the shell shape configuration does not provide an adjustable means for resting the shoulder area of the user in an orthopedic relationship between the head, neck and shoulder area.

OBJECTS OF THE INVENTION

Accordingly, it is one object of the present invention to provide a bath pillow that cushions the head, neck, and shoulder area of its user against the hard surfaces of the wall and tub structures.

It is another object of the present invention to provide a bath pillow that may be anchored to the ceramic surfaces of the tub and wall area.

It is yet another object of the present invention to provide a bath pillow that conforms to the orthopedic relationship of the head, neck, and shoulder regions of its user.

Finally, it is an object of the present invention to provide a bath pillow that adjusts to conform to the head and shoulder area of its user.

SUMMARY OF THE INVENTION

The present invention is a bath pillow adapted to be anchored to and supported by a bathtub-like structure and a wall structure, so as to present a user with a resting place for his or her head and the shoulder region of his or her back.

The bath pillow has a head support cushion which has a bottom edge, a top edge, a back face, and a front face. The front face and the back face together form a first envelope. A soft, pliable, and moistureproof core is inserted into the first envelope.

A plurality of suction cups are capable of being anchored to either or both the bathtub-like structure and the wall structure. Preferably, two straps, which bridge between two of the suction cups and the top edge of the head support cushion, are connected to each of the two suction cups.

A shoulder support cushion also has a bottom edge, a top edge, a back face, and a front face, with the front face and the back face joined together to form a second envelope. The shoulder support cushion also has a soft, pliable, and moisture proof core, which is inserted into this second envelope.

Of the plurality of suction cups, preferably two other suction cups are anchored to the bathtub-like structure with straps connected to each. These straps also bridge between the suction cups and a portion of the bath pillow; more specifically, the straps bridge between the suction cups and the bottom edge of the shoulder support cushion.

A strip of Velcro TM is permanently attached to the head support cushion approximate its lower edge, and a complimentary strip of Velcro TM material is permanently attached to the shoulder support cushion approximate its upper edge. These strips provide a means for attaching the head support cushion to the shoulder support cushion to form a unitary structure that is the bath pillow, although a unitary structure may be had by permanently affixing the cushions together. The strips of Velcro TM material are elongate so that the cushions may overlap and provide a certain amount of adjustability for the user to achieve an orthopedic fix corresponding to his or her head and shoulder region.

According to the intended use of the invention, the two suction cups, which are connected to the straps attached to the top edge of the head support cushion, are anchored to the wall structure, and the two suction cups, which are connected to the straps attached to the bottom edge of the shoulder support cushion, are anchored to the bathtub-like structure. The user may lie in the bathtub-like structure and rest his or her head against the head support cushion and simultaneously rest the back of his or her shoulders against the shoulder support cushion. The user may adjust the overlap between the head support cushion and the shoulder support cushion for orthopedic comfort. The user may fill the bathtub-like structure with water without special concern for the bath pillow, as the bath pillow is preferably made of a pliable, water tight material.

DETAILED DESCRIPTION OF THE PREFERRED EMBODIMENTS

Figure 1:
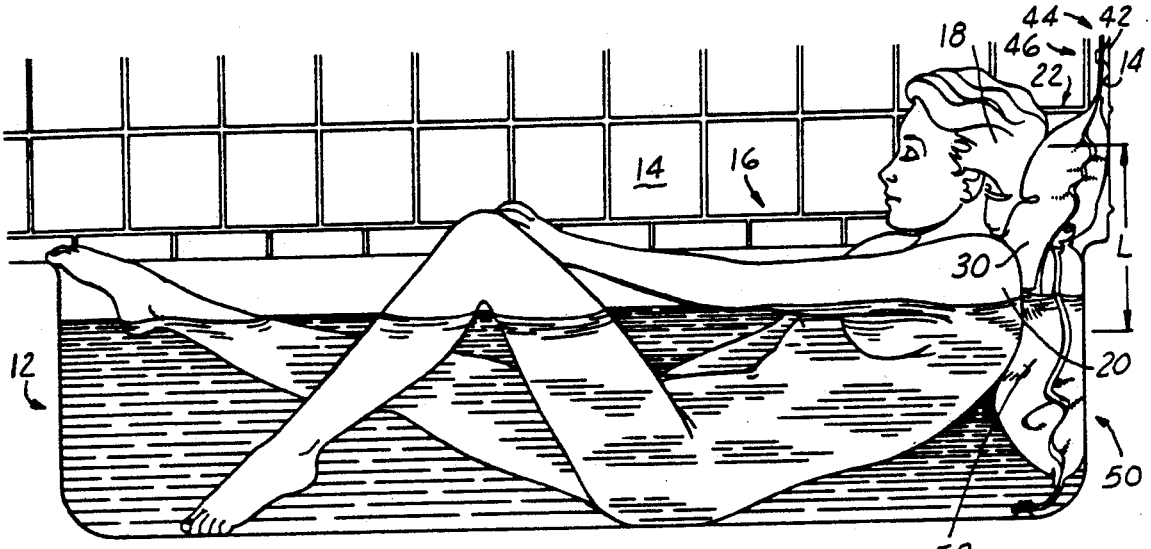
FIG. 1 shows a side elevational view of the bath pillow with a bather/user reclining against it.

Reference being made first to FIG. 1, a bath pillow 10 is shown anchored to and supported by a bathtub-like structure 12 and a wall structure 14. The bathtub-like structure 12 shown in FIG. 1 is actually a conventional bathtub, but it is contemplated that the invention will be used in a variety of bathtub-like structures, including Jacuzzi TM whirl pools, hot tubs, sunken tubs, and pools. It is appreciated that bathtubs are most often found in an environment of surrounding ceramic walls. Sunken tubs, on the other hand, are usually found in an environment of a surrounding ceramic floor. Accordingly, it is contemplated that the invention may be used in a manner that it will be anchored to a floor structure in lieu of a wall structure. Within the range of possibilities to be described or otherwise available to those of ordinary skill in the art, it is seen that a user 16 is presented with a resting place for his or her head 18 and the shoulder region 20 of his or her back.

Referring now to all of Figures until certain Figures are particularly called for, the bath pillow 10 has a first support cushion 22. This first support cushion 22, or more specifically, the head support cushion 22, has a bottom edge 24, a top edge 26, a back face 28, and a front face 30. In the preferred first embodiment shown in FIG. 2, the front face 30 and the back face 28 (hidden from the view shown in FIG. 2) each has generally a rectangular shape bounded by additional edges 32 and 34. The shape, however, is not a limitation of the invention.

Figure 3:
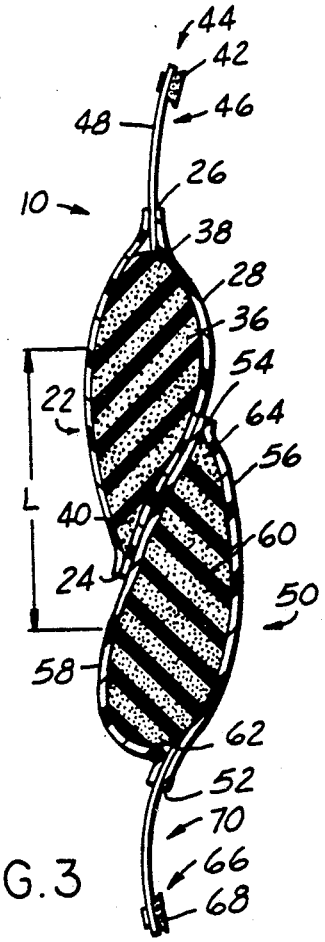
FIG. 3 is a cross sectional view along line 3—3 of FIG. 1.
Figure 4:
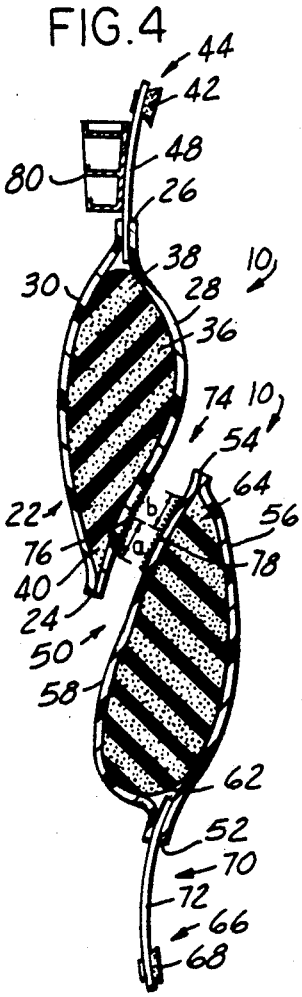
FIG. 4 is a view of the bath pillow with its pillows separated, the view being in accordance with the sectional view of FIG. 3.

The front face 30 and the back face 28, with edges joined together, form a first envelope into which is inserted a soft, pliable and moistureproof core 36, as is shown in FIGS. 3 and 4. As can be seen in these Figures, the cross section of the core 36 is generally teardrop shaped, having a rounded portion 38 and a tear point 40.

A first anchoring means 42 consists of at least one suction cup 44 of a plurality of suction cups which are capable of being anchored to either or both the bathtub-like structure 12 and/or the wall structure 14. Preferably, two suction cups 44 are anchored to the wall structure 14. A first bridging means 46, that is, a means bridging between the suction cups 44 and the pillow 10 is provided by straps 48 attached to each suction cup 44. Straps 48 bridge between the suction cups 44 and the top edge 26 of head support cushion 22. As can be seen in FIGS. 3 and 4, straps 48 are attached to the top edge 26 of head support cushion 22 by means known to those of ordinary skill in the art, as, for example, by inserting straps 48 between front face 30 and back face 28 and material-welding, gluing, or stitching front face 30, back face 28, and straps 48 together.

A shoulder support cushion 50 is also shown to have a bottom edge 52, a top edge 54, a back face 56, and a front face 58, with the front 58 and the back face 56 joined together to form a second envelope. The shoulder support cushion 50 also has a soft, pliable, and moistureproof core 60, also having a teardrop shaped cross section with a rounded portion 62 and a tear point 64. Core 60 is inserted into the second envelope and the edges thereof are joined together. As can be seen from FIG. 2, the front a back faces 58 and 56 of shoulder support cushion 50 have generally a semicircular shape.

A second anchoring means 66 is provided by the plurality of suction cups. Preferably, two other suction cups 68 are anchored to the bathtub-like structure 12. Second bridging means 70, preferably embodied as straps 72, are connected to suction cup 68 so as to bridge between the suction cup 68 and the bottom edge 52 of the shoulder support cushion 50 to which the straps are attached.

A means of attaching head support cushion 22 to shoulder support cushion 50 is shown in FIG. 4, although it is to be understood that a unitary structure for bath pillow 10 may be had by permanently affixing the cushions together. In the preferred embodiment of FIG. 4, attaching means 74 has a first attaching part 76 attached to head support cushion 22 proximate bottom edge 24. First attaching part 76 is attachable to a second attaching part 78 which is attached to shoulder support cushion 50, proximate the upper or top edge 54 thereof.

To be more specific, it is preferred that first attaching part be a strip of Velcro TM material permanently attached to the back face 28 of head support cushion 22. Second attaching part 78, then, would be a complimentary strip of Velcro TM material permanently attached onto the front face 58 of shoulder support cushion 50. Following such preference, the strips of Velcro TM are situated on the cushions 22 and 50 so that, when head support cushion 22 is attached to shoulder support cushion 50, cross sections of the cores 36 and 60 of respective cushions 22 and 50 being generally teardrop shaped, rounded portions 38 and 62 are respectively situated approximate the top edge 26 of head support cushion 22 and the bottom edge 52 of shoulder support cushion 50 and the tear points 50 and 64 overlap.

Still more specifically, the strips of Velcro TM material are elongate strips to provide a means for adjusting the overlapping relationship between support cushions 22 and 50. Thus, the greater the axial contact between strips 76 and 78 in FIG. 4, the greater the overlap between cushions 22 and 50. Accordingly, the greater the overlap between cushions 22 and 50, the shorter the length "L" in FIGS. 1 and 3 between support for the head 18 and support for the shoulder region of the back 20 in FIG. 1. The reverse is also true, so that is only a length "a" of FIG. 4, were in contact with a length "b" of the same figure, "L" would be lengthened for a taller user 16 of FIG. 1.

Figure 2:
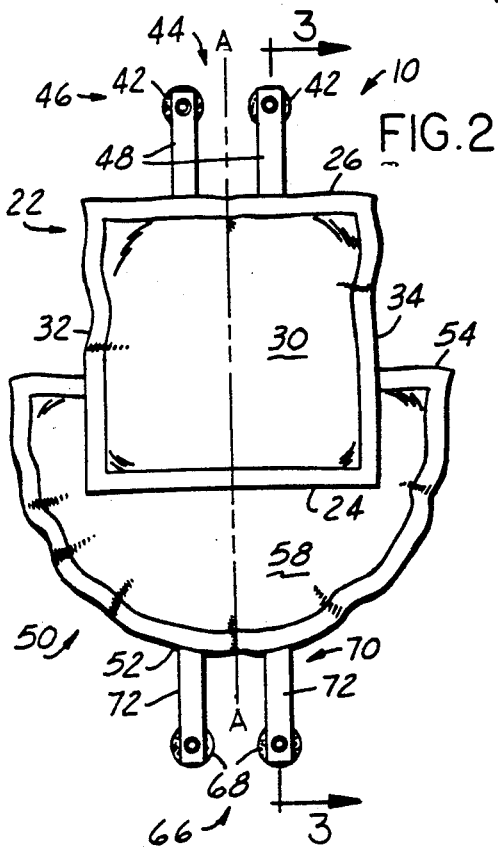
FIG. 2 is a front elevational view of the bath pillows shown in FIG. 1.

It is also to appreciated that, for the particular, preferred embodiment that has head support cushion 22 having generally a rectangular shape and shoulder support cushion 50 having generally a semicircular shape, strip 76 is permanently attached onto the back face 28 of head support cushion 22 and complimentary strip 78 is permanently attached onto the front face 58 of shoulder support cushion 50 in a manner that, when the cushions 22 and 50 are attached, the front faces of both cushions 22 and 50 have a common axis of symmetry A—A shown in FIG. 2. Strip 76 and 78 may be permanently attached to cushions 22 and 50, respectively, along axis A—A, or strip 76 and 78 may each be two strips 76 and 78, two strips 76 being disposed to either side of A—A and two strips 78 also being disposed to either side of axis A—A.

As an optional feature, a caddy 80 is provided for holding bath accessories, for example, soap and shampoo. Caddy 80 is preferably carried by straps 48, as shown in FIG. 4.

According to the intended use of the invention, the two suction cups 44 connected to straps 48, which are attached to the top edge 26 of the head support cushion 22, are anchored to the wall structure 14, and the two suction cups 42 connected to straps 72, which are attached to the bottom edge 52 of the shoulder support cushion 50, are anchored to the bathtub-like structure 12. User 16 may lie in the bathtub-like structure 12 and rest his or her head 18 against the head support cushion 22, while simultaneously resting the back of his or her shoulders 20 against the shoulder support cushion 50. User 16 may fill the bathtub-like structure with water without special concern for the bath pillow 10, as bath pillow 10 is preferably made of a pliable, watertight material. While cores 36 and 60 have both been described as moisture-proof, it should be understood that, as long as the material of the bath pillow 10 is watertight and all of the seams thereof are also watertight, cores 36 and 60 may be made of any soft material, for example cotton, and yet the pillow will still be immersible.

I claim:

1. A bath pillow having a front and a back, said pillow being adapted to be supported by at least one of two supporting structures, including a bathtub-like structure and a wall structure, and to be anchored to at least one of said two supporting structures so that a user may rest at least a head of the user against the front of said bath pillow, the bath pillow comprising:

a first support cushion to support said head of the user, said first support cushion having a front face and a back face and a generally tear-shaped cross-section that is generally perpendicular to said front face and said back face of said first support cushion, said cross-section of said first support cushion having a rounded portion and a tear point;

first anchoring means;

first bridging means having a first attachment with said first support cushion, said first bridging means for bridging between said first attachment and said first anchoring means, said first anchoring means being connected to said first bridging means for anchoring the bath pillow to said at least one of two supporting structures;

a second support cushion to support a shoulder region of the back of the user, said second support cushion having a front face and a back face and a generally tear-shaped cross-section that is generally perpendicular to said front face and said back face of said second support cushion, said cross-section of said second support cushion having a rounded portion and a tear point;

second anchoring means connected to said second support cushion for anchoring the bath pillow to said at least one of two supporting structures; and attaching means for attaching said first and second support cushions to one another in an overlapping relationship characterized by a portion of the back face of said first support cushion opposing a portion of the front face of said second support cushion and the tear points of said cross-section of said first and said second support cushions overlapping.

2. The bath pillow of claim 1, wherein the overlapping relationship between said first and second support cushions is adjustable.

3. The bath pillow of claim 1, wherein said first support cushion and said second support cushion each has an upper edge and a lower edge, said first bridging means extending beyond the upper edge of said first support cushion, said attaching means having a first attaching part attached to said first support cushion proximate the lower edge thereof and attachable to a second attaching part and said attaching means having said second attaching part attached to said second support cushion proximate the upper edge thereof, whereby the bath pillow is adapted to depend from said at least one of two supporting structures so that the user may rest the head against said first support cushion and simultaneously rest the shoulder region of the back against said second support pillow.

4. The bath pillow of claim 3 wherein said first attaching part is detachable from said second attaching part so that said first support cushion may be used separately and apart from said second support cushion.

5. The bath pillow of claim 4 wherein said first attaching part and said second attaching part are both made of complementary Velcro TM material.

6. The bath pillow of claim 5 further comprising a caddy carried by said at least one strap, for holding bath accessories.

7. The bath pillow claim 3, whereby the bath pillow is adapted to be anchored to the other of said two supporting structures.

8. The bath pillow of claim 1 wherein said first anchoring means includes at least one suction cup.

9. The bath pillow of claim 8 wherein said first bridging means includes at least one strap extending from said first attachment with said first support cushion to said at least one suction cup.

10. The bath pillow of claim 1 wherein said first anchoring means and said second anchoring means include suction cups.

11. The bath pillow of claim 1 wherein the bath pillow is made of a pliable, watertight material and wherein said first support cushion and said second support cushion each has an inner core enveloped by said material, said inner core being made of a resilient material.

12. The bath pillow of claim 11 wherein said resilient material is moisture proof.

13. The bath pillow of claim 1 further comprising second bridging means having a second attachment with said second support cushion, said second bridging means for bridging between said second attachment and said second anchoring means.

14. A bath pillow adapted to be anchored to and supported by a bathtub-like structure and a wall structure, so as to present a user with a resting place for a head and shoulder region of the back of the user, the bath pillow comprising:

a head support cushion having a bottom edge, a top edge, a back face, and a front face, the front face and the back face of said head support cushion being joined together to from a first envelope, said head support cushion having a soft, pliable, and mositure proof head cushion core inserted into said first envelope, said head cushion core having a generally tear-shaped head cushion core cross-section, said head cushion core cross-section having a rounded portion and a tear point, the rounded portion of said head cushion core cross-section being situated proximate the top edge of said head support cushion;

a plurality of suction cups capable of being anchored to one of the bathtub-like structure and the wall structure;

at least one strap being attached to the top edge of said head support cushion and extending from the top edge of said head support support cushion to at least one suction cup of the plurality of suction cups and being connected thereto;

a shoulder support cushion having a bottom edge, a top edge, a back face, and a front face, the front face and the back face of said shoulder support cushion being joined together to form a second envelope, the shoulder support cushion having a soft, pliable, and moisture proof shoulder cushion core inserted into said second envelope, said shoulder cushion core having a generally tear-shaped shoulder cushion core cross-section, said shoulder cushion core cross-section having a rounded portion and a tear point, the rounded portion of said shoulder cushion core cross-section being situated proximate the bottom edge of said shoulder support cushion;

at least one strap being attached to the bottom edge of said shoulder support cushion and extending from the bottom edge of said shoulder support cushion to at least another one suction cup of the plurality of suction cups and being connected thereto;

an elongate strip of Velcro TM material permanently attached to said head support cushion proximate the lower edge thereof and a complementary elongate strip of Velcro TM material permanently attached to said shoulder support cushion proximate the upper edge thereof so that said head support cushion is attachable to said shoulder support cushion with the tear points overlapping, whereby said at least one suction cup, which is connected to at least one strap attached to the top edge of said head support cushion, may be anchored to the wall structure and said another one suction cup, which is connected to at least one strap attached to the bottom edge of said shoulder support cushion, may be anchored to the bathtub-like structure, which will orient and anchor the bath pillow so that the user may rest the head against said head support cushion and simultaneously rest the shoulder region of the back against said shoulder support pillow.

15. The bath pillow of claim 14 wherein the bath pillow is made of a pliable, watertight material.

16. The bath pillow of claim 14 wherein the semicircular shaped faces of said shoulder support cushion have a diameter that is greater in length than the length of the bottom edge of said head support cushion.

17. The bath pillow of claim 14 wherein said strip of Velcro TM material is permanently attached onto the back face of said head support cushion and said complementary strip of Velcro TM material is permanently attached onto the front face of said shoulder support cushion, said tear points being adjustable in their overlapping relationship.

18. A bath pillow adapted to be anchored to and supported by a bathtub-like structure and a wall structure, so as to present a user with a resting place for a head and a shoulder region of the back, the bath pillow comprising:

a head support cushion having a bottom edge, a top edge, a back face, and a front face, the front face and the back face of said head support cushion being joined together to from a first envelope, said head support cushion having a soft, pliable, and moisture proof core inserted into said first envelope, and the front and back faces of said head support cushion having generally a rectangular shape;

a plurality of suction cups capable of being anchored to one of the bathtub-like structure and the wall structure;

at least one strap being attached to the top edge of said head support cushion and extending from the top edge of said head support support cushion to at least one suction cup of the plurality of suction cups and being connected thereto;

a shoulder support cushion having a bottom edge, a top edge, a back face, and a front face, the front face and the back face of said shoulder support cushion being joined together to form a second envelope, the shoulder support cushion having a soft, pliable, and moisture proof core inserted into said second envelope, the front and back faces of said shoulder support cushion having generally a semicircular shape;

at least one strap being attached to the bottom edge of said shoulder support cushion and extending from the bottom edge of said shoulder support cushion to at least another one suction cup of the plurality of suction cups and being connected thereto;

an elongate strip of Velcro TM material permanently attached onto the back face of said head support cushion proximate the lower edge thereof and a complementary elongate strip of Velcro TM material permanently attached onto the front face of said shoulder support cushion proximate the upper edge thereof so that said head support cushion is attachable to said shoulder support cushion, the strips of Velcro TM being situated on the cushions so that when said head support cushion is attahced to said shoulder support cushion, the front faces of both cushions have a common axis of symmetry, and wherein the cross-sections of the cores of both cushions at the common axis of symmetry are generally tear-shaped, rounded portions of the cushions being situated proximate the top edge of said head support cushion and the bottom edge of said shoulder support cushion, whereby said at least one suction cup, which is connected to at least one strap attached to the top edge of said head support cushion, may be anchored to the wall structure and said another one suction cup, which is connected to at least one strap attached to the bottom edge of said shoulder support cushion, may be anchored to the bathtub-like structure, which will orient and anchor the bath pillow so that the user may rest the head against said head support cushion and simultaneously rest the shoulder region of the back against said shoulder support pillow.

* * * * *